United States Patent [19]

Robertson

[11] 4,451,867

[45] May 29, 1984

[54] ELECTRICALLY ACTUABLE IGNITION ASSEMBLY

[75] Inventor: James Robertson, Irvine, Scotland

[73] Assignee: Imperial Chemical Industries PLC, London, England

[21] Appl. No.: 415,542

[22] Filed: Sep. 7, 1982

[30] Foreign Application Priority Data

Sep. 28, 1981 [GB] United Kingdom ..... 8129283

[51] Int. Cl.[3] ..... F42C 11/00; H01R 9/08

[52] U.S. Cl. ..... 361/248; 339/98

[58] Field of Search ..... 339/98; 361/263, 264, 361/247, 248; 219/260, 267

[56] References Cited

U.S. PATENT DOCUMENTS

| | | | |
|---|---|---|---|
| 2,933,653 | 4/1960 | Carter | 361/248 |
| 3,388,370 | 6/1968 | Elm | 339/98 |
| 3,745,228 | 7/1973 | Vogt | 174/88 |
| 4,099,822 | 7/1978 | Carlisle et al. | 339/98 |
| 4,297,947 | 11/1981 | Jones et al. | 361/248 |

FOREIGN PATENT DOCUMENTS

| | | |
|---|---|---|
| 0020241 | 12/1980 | European Pat. Off. . |
| 0020031 | 12/1980 | European Pat. Off. . |
| 1520036 | 8/1978 | United Kingdom . |
| 1543705 | 4/1979 | United Kingdom . |
| 2014380A | 8/1979 | United Kingdom . |
| 2015832A | 9/1979 | United Kingdom . |
| 2022222A | 12/1979 | United Kingdom . |
| 1558582 | 1/1980 | United Kingdom . |
| 2037494A | 7/1980 | United Kingdom . |
| 2050079A | 12/1980 | United Kingdom . |
| 2091955A | 8/1982 | United Kingdom . |

*Primary Examiner*—Donald A. Griffin

*Attorney, Agent, or Firm*—Cushman, Darby & Cushman

[57] ABSTRACT

An electrically actuable ignition assembly comprising an electric ignition element having insulated electrical leading wires connected by means of conducting metal contact elements to the ends of a secondary winding of insulated wire on a transformer ring core. The transformer core and contacts are preferably encased in a synthetic plastics case. The assembly is for use in blasting operations in which multi-shot rounds are fired from an a.c. supply by electromagnetic coupling of the supply with the secondary winding by means of a single primary wire threaded through the ring cores of a plurality of assemblies. The use of the metal contact elements eliminates the previously used soldered joints between the ignition element leading wires and the transformer secondary winding.

11 Claims, 5 Drawing Figures

ELECTRICALLY ACTUABLE IGNITION ASSEMBLY

Figure 1:
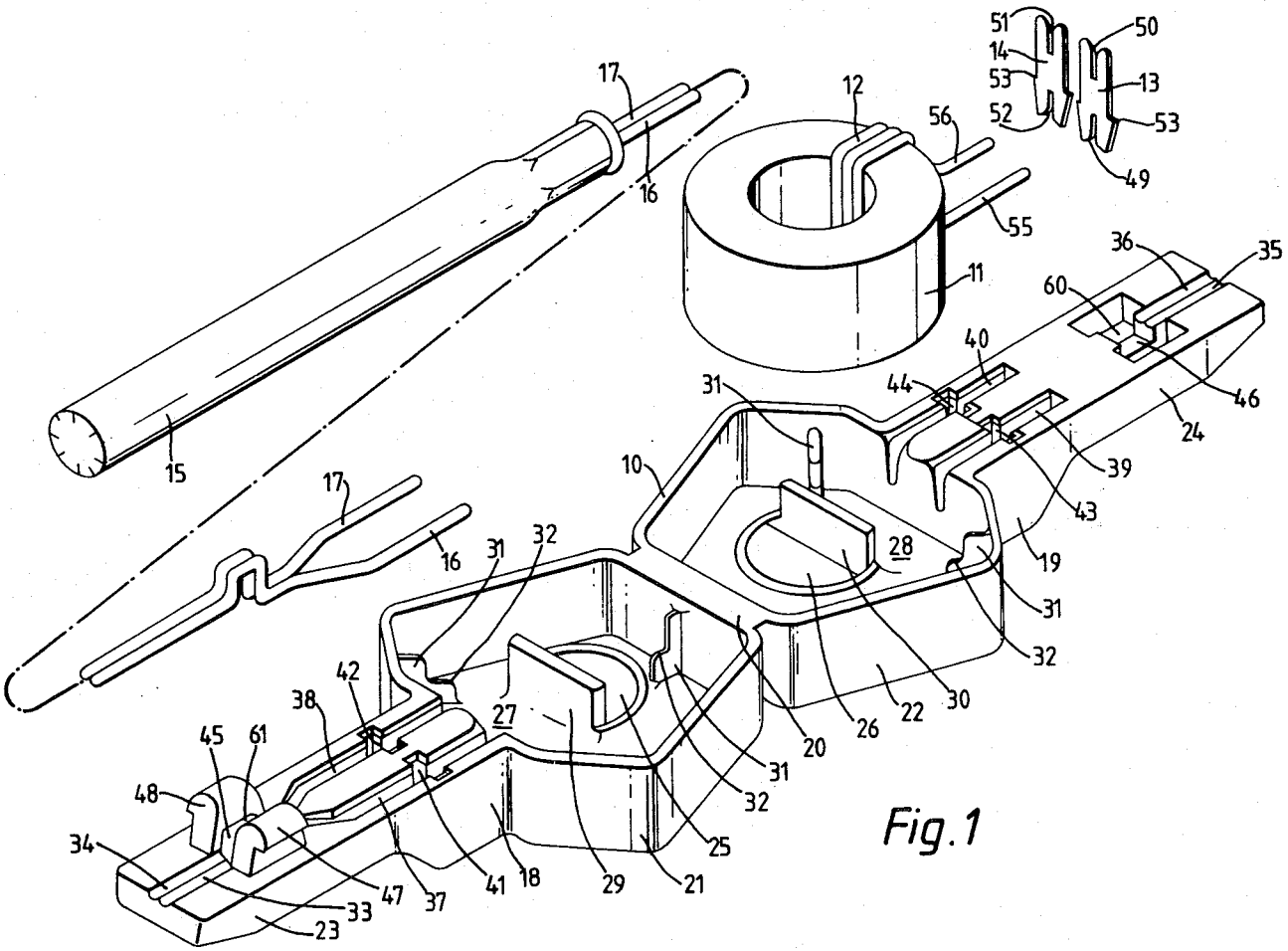

This invention relates to an electrically actuable ignition assembly adapted for electromagnetic coupling to an a.c. source of firing energy. More particularly the invention relates to an assembly comprising an encased resistive electric ignition element having insulated electrical leading wires external to said casing electromagnetically coupled to a transformer ring core by at least one loop of insulated wire wrapped as a secondary winding on the transformer core.

Electromagnetically coupled detonator assemblies wherein an electric detonator is electromagnetically coupled to a ferrite ring are described in our United Kingdom Patent Specification No. 2 022 222A and are commercially available under the trade name 'Magnadet'. In these detonators a continuous circuit of conductor wire is connected across the terminals of the encased resistive electric ignition element of a detonator, a portion of leading wire external to the casing being fully insulated and wound as a secondary winding of 3–5 turns on a toroidal ferrite core. For ease of manufacture the toroidal core and secondary winding are assembled in a first operation and the detonator is separately assembled with a length of insulated external leading wire extending from each of the two terminals of the resistive elements to a position outside the casing. A bared end portion of each leading wire is electrically connected respectively to bared portions of the two ends of the secondary winding to complete the electrical circuit across the ignition element. The joints between the wires and the toroidal ferrite core are encased in a synthetic plastics protective casing thereby fully insulating the external electrical circuit of the detonator. The protective casing is provided with a central opening through which an electric conductor wire may be threaded as a single loop primary winding for the toroidal transformer core and connected to a suitable source of alternating current for firing the detonator. A single primary wire may be threaded through several toroidal rings for the simultaneous initiation of all the associated detonators. These electromagnetically coupled detonators have attractive safety characteristics, being substantially immune to stray electric currents and static electricity and being frequency selective so that signals outside a designed band of about 10 to 100 kHz are effectively attenuated. The detonators are also attractive to users as the connection of multi-shot rounds to the firing source for blasting is easily and rapidly made, the wiring joints in the detonator circuit being substantially eliminated. In the 'Magnadet' detonators currently used the joints between the secondary winding and the external leading wires from the detonator element are made by twisting and/or soldering end portions of the wires from which the insulating material, usually polyvinyl chloride, has been stripped. The making of these joints therefore requires several time-consuming operations. It is an object of this invention to provide a transformer coupled electrically actuable ignition assembly which does not necessitate the formation of joints between prestripped wire ends.

In accordance with this invention an electrically actuable ignition assembly comprises an encased resistive electric ignition element having a length of electrical leading wire connected to each of its two terminals and extending outside the case, the portions of wire outside the case being fully insulated, a transformer ring core having an insulated length of electrical conductor wire wound thereon as a secondary winding, and two electrically conducting metal contact elements each electrically connecting an end portion of the secondary winding to a corresponding one of said lengths of electrical leading wire to complete an electrical circuit across said terminals, said contact element having portions penetrating the insulating layer on the respective wires.

The contact elements are preferably portions of thin metal sheet, each portion being formed with one or more slots extending from at least one edge thereof, said slots being of such width that when the insulated wire portion is inserted into the slot the metal edges at the slot sides penetrate the insulating material on the wire and make electrical contact with the wire. Preferably the metal contact elements are each provided with at least two slots and conveniently the slots are disposed to extend from opposite edges of the element. If desired, the contact element may comprise a portion of metal sheet doubled to provide two substantially parallel portions with a portion connecting the parallel portions, slots being formed in the opposing free edges of the parallel portions.

The transformer ring core is preferably a toroidal ring core of ferrite material. For protection in use the toroidal ring core with its secondary winding, the contact elements and the portions of wire adjacent thereto are preferably encased in a synthetic plastics case, the case being provided with apertures coincident with the central opening of the toroidal ring core through which apertures a loop of insulated wire may be threaded to serve as a primary winding for the transformer. The apertures should preferably be such as to leave a portion of the inside circumferential surface of the ring core exposed. The preferred case provides an annular chamber to accommodate the toroidal ring and a communicating conduit adapted to accommodate and firmly retain the contact elements and wire portions. The toroidal ring core is preferably supported on internal projections in the annular chamber such that an annular air space is provided around the outside of the ring core to provide protection against impact.

The case is preferably a substantially rigid case, fabricated for example from polypropylene.

Conveniently the case is constructed in two portions, one portion being a lower or base portion and the other an upper or lid portion. One portion may be adapted to accommodate the end portions of the electrical leading wires of the ignition element and the other portion adapted to accommodate the transformer ring core, the secondary winding and the contact elements, the case portions being adapted to close together so as to bring each contact element into contact with an electrical leading wire and an end portion of the secondary winding. Preferably the case portions are of substantially equal size, the plane of contact between the portions being the medial plane of the case. The case portions are preferably formed with at least one projection and at least one corresponding recess whereby, on closing the case, the two case portions become firmly locked together, for example, by snap-lock engagement. In an especially preferred assembly the case is made as a single injection moulding with the two parts being joined by a thin hinge portion. For this form of case polypropylene is the preferred construction material because of its superior flexing properties.

Figure 2:
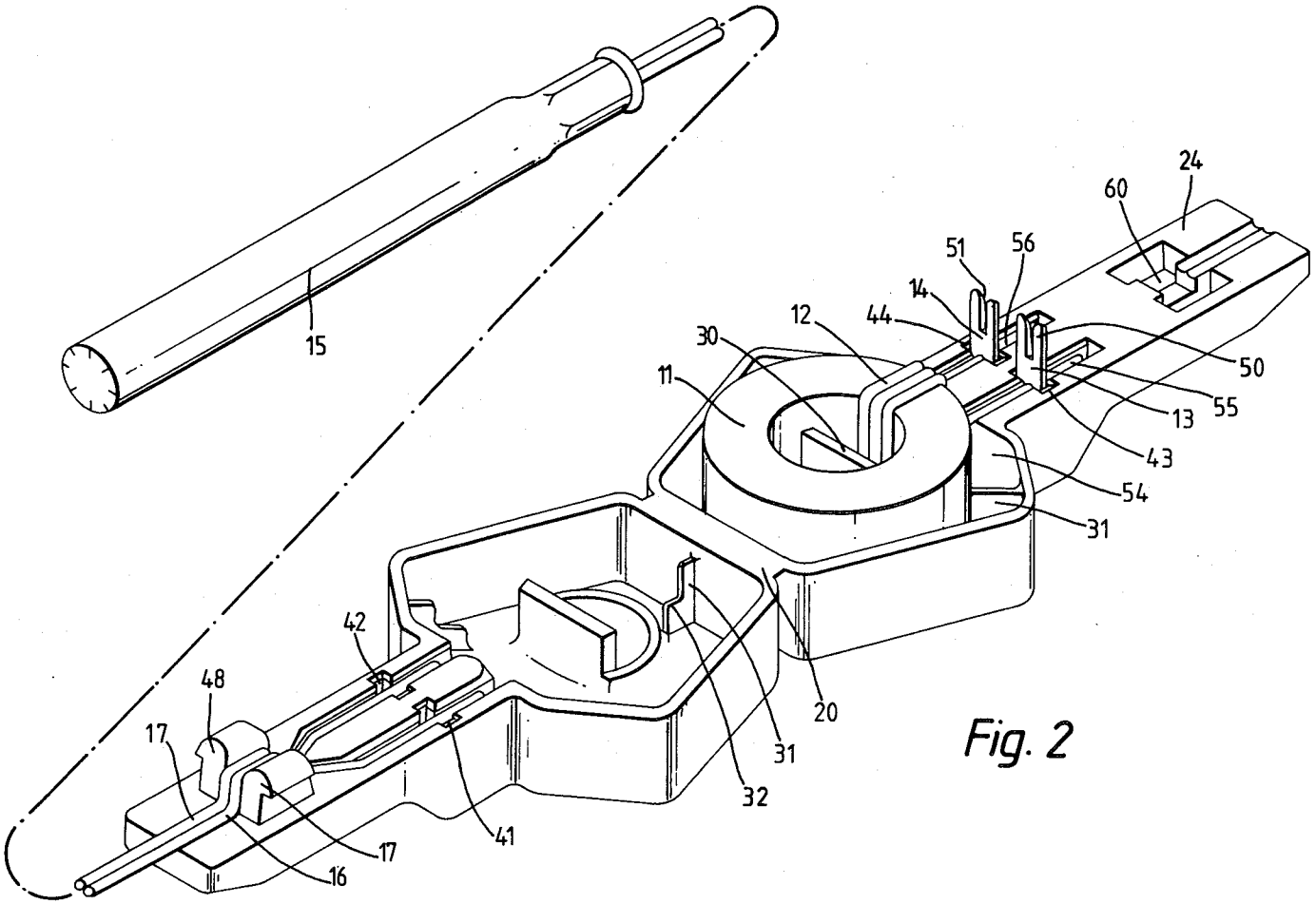
Figure 4:
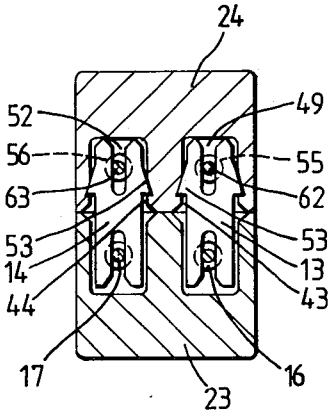
Figure 5:
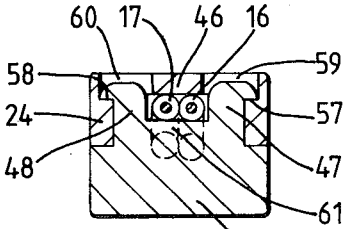
Figure 3:
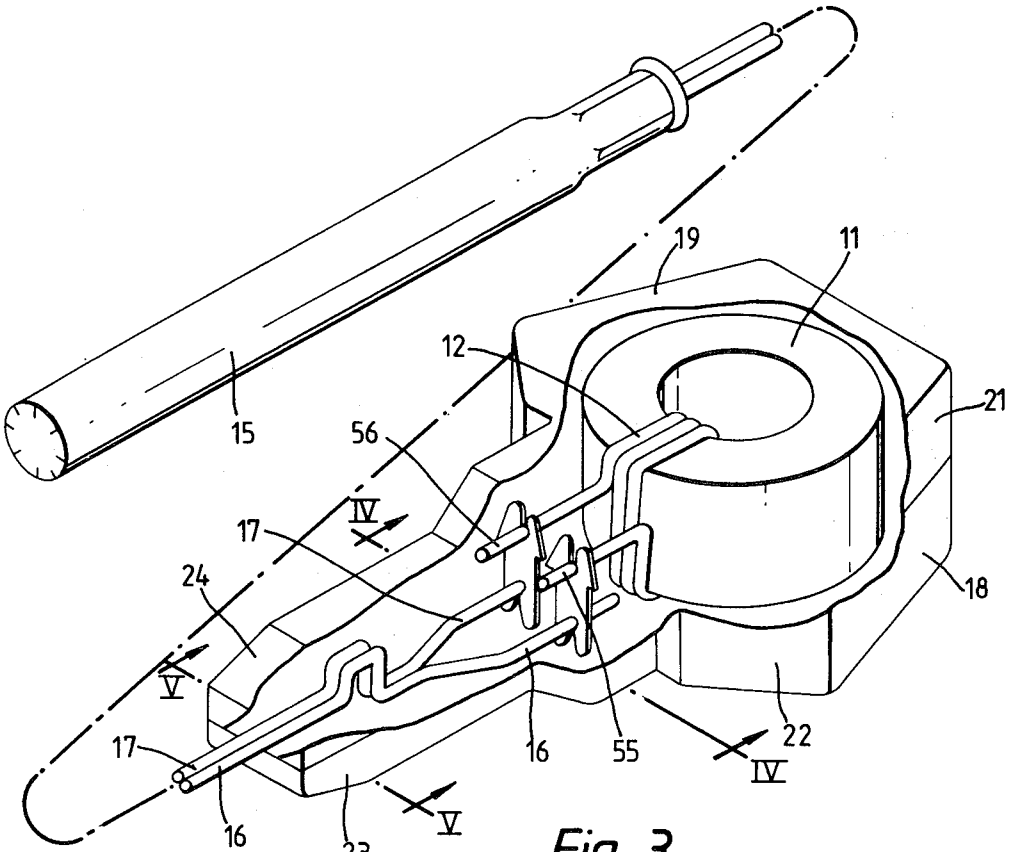

The invention is further illustrated by the preferred embodiment which is hereinafter particularly described, by way of example, with reference to the accompanying drawings wherein FIG. 1 shows diagramatically in perspective the separate parts of an assembly of the invention, FIG. 2 shows in perspective the assembly with the parts of FIG. 1 positioned in the open case of the assembly, FIG. 3 shows in perspective the assembly of FIGS. 1 and 2 with the case closed, part of the case being cut away, FIG. 4 is a cross-section on the line IV—IV of FIG. 3, FIG. 5 is a cross-section on the line V—V of FIG. 3.

Referring to FIG. 1, the assembly comprises a case 10, toroidal ferrite ring core 11, secondary winding 12, contact elements 13 and 14 and electric detonator 15 having two electric leading wires 16 and 17. The case 10 is injection moulded as a single moulding having two portions conveniently designated as lower portion 18 and upper portion 19, joined by a thin hinge portion 20. Both portions 18 and 19 consist of generally hollow open topped boxes 21 and 22, and generally solid lateral portions 23 and 24 extending respectively from a side of each hollow portion 21 and 22.

The boxes 21 and 22 have D-shaped central apertures 25 and 26 disposed centrally one in each of the bottom faces 27 and 28 of the boxes 21 and 22. Vertical rectangular upstands 29 and 30 project from the faces 27 and 28 at the side of the apertures 25 and 26 nearest to the lateral portions 23 and 24, the upstands being transverse to the lateral portions 23 and 24. The boxes 21 and 22 also each have three internal webs 31, each shaped with a supporting shoulder 32 so as to support the ring core 11 with an annular space between the ring core and the box sides.

The solid portions 23 and 24 are formed with shallow grooves of semicircular cross-section 33,34,35,36, and deep grooves 37,38,39 and 40, the shallow grooves being approximately of the same radius as the leading wires 16 and 17 and the deep grooves being of a depth greater than the diameters of the leading wires 16 and 17 and the secondary winding 12. The grooves 37,38,39 and 40 are formed with pockets 41,42,43 and 44, one in each groove, adapted to receive an end of a contact element 13 and 14. The solid portion 23 is formed with a projecting portion 45, consisting of a transverse rib 61 and locking hooks 47 and 48, adapted to enter and engage in a recess 46 formed in the solid portion 24, the locking hooks 47 and 48 being adapted to lock with corresponding steps 57 and 58 in the outer side walls of apertures 59 and 60 formed in the base of the recess 46, as shown in FIG. 5.

The contact elements 13 and 14 are flat elongated metal stampings formed with elongated slots 49,50,51 and 52 extending from the ends of the elements, the slots being generally parallel sided and approximately the width of the metal core of the insulated wire of the leading wires 16 and 17 and the end portions 55 and 56 of the secondary winding 12 which they are designed to contact. At the end of the slots the slot sides are divergent to assist entry of the insulated wires. The elements 13 and 14 are formed with tapered projecting shoulder portions 53 at their lower ends to act as locking barbs when the elements are inserted into pockets 43 and 44 respectively.

The ring core 11 is in the form of a short hollow cylinder (although it is conventionally termed a toroid) and the second winding 12 consists of 3 turns of plastics insulated wire of the same kind as used for the detonator leading wires 16 and 17.

In putting the assembly together the parts are first assembled as shown in FIG. 2. The ring core 11 is placed in the box 22 around the upstand 30 with its outer edge resting on the shoulders 32 so as to leave an annular space 54 around the core 11. The core 11 is oriented so that the secondary winding 12 lies between the upstand 30 and the lateral portion 24 and the end portions 55 and 56 of the secondary winding 12 are placed respectively in the grooves 39 and 40. The lower ends of the contact elements 13 and 14 are then inserted into pockets 43 and 44 respectively, the wire portions 55 and 56 entering the slots 49 and 52 respectively. The sides of the slots 49 and 52 cut through the plastics insulation and make electrical contact with the metal wire cores 62 and 63 of the wire portions 55 and 56 and the shoulders 53 of the elements 13 and 14 become locked in the pockets 43 and 44 as shown in FIG. 4. The end portions of the leading wires 16 and 17 are trained over the transverse rib 61, the wire 16 being inserted in the grooves 33 and 37 and wire 17 being inserted in grooves 34 and 38, the wire ends extending through the pockets 41 and 42.

The assembly is completed by folding the upper portion 18 around the hinge 20 to close the two portions 18 and 19 together as shown in FIG. 3 with the projecting portion 45 locked into the recess 46 (see FIG. 5). In this closing operation the upper ends of the contact elements 13 and 14 are forced into pockets 41 and 42 respectively so that the wires 16 and 17 enter the slots 50 and 51 respectively, the sides of the slots cutting the wire insulation and making electrical contact with the metal wire core as shown in FIG. 4. Thus electrical contact is established between secondary winding portion 55 and detonator leading wire 16 and between secondary winding portion 56 and detonator leading wire 17 to provide a continuous circuit coupling the secondary winding 12 and the ignition element of detonator 15. In the closed position the top edges of the boxes 21 and 22 abut each other. The upstand 29 abuts upstand 30 to provide an annular chamber enclosing the ring core 11 with an air space around almost all the ring core surface. A portion of the inner curved surface of the ring core 11 coincident with the curved rims of the D-shaped apertures 25 and 26 is left uncovered. The leading wires 16 and 17 are bent over the rib 61 and firmly gripped between rib 61 and the base and side walls of the recess 46 so that the joints between the wires and the contact elements are protected from tensioning of the wires in use. In the closed case the grooves 33,34,35 and 36 form tubular passages closely fitting around the wires 16 and 17 through which passages the wires 16 and 17 emerge.

It is generally convenient to connect the detonator 15 as the last item of the assembly. Thus, if desired, the assembly of FIG. 2 except for the detonator may be prepared at one site and at another site the detonator may be added and the assembly closed to complete the assembly as shown in FIG. 3.

In use, the detonator 15 is fired by threading an insulated electrical conductor wire through the apertures 25 and 26 and the ring core 11 and passing an alternating current of appropriate frequency through the conductor wire, whereby a firing current is electromagnetically induced in the secondary winding 12 and in the ignition element of the detonator. If desired, a single conductor wire may be threaded through the ring cores of several assemblies to fire several detonators simultaneously from a single source of electrical energy.

I claim:

1. An electrically actuable ignition assembly comprising an encased resistive electric ignition element having two terminals and a length of electrical leading wire connected to each terminal, said wire lengths extending outside the case, the portions of wire outside the case being fully insulated, a transformer ring core having an insulated length of electrical conductor wire wound thereon as a secondary winding, and two electrically conducting metal contact elements each electrically connecting an end-portion of the secondary winding to a corresponding one of said lengths of electrical leading wire to complete an electrical circuit across said terminals, said contact elements having portions penetrating the insulating layer on the respective wires and contacting the wire.

2. An assembly as claimed in claim 1 wherein the contact elements are portions of thin metal sheet, each portion being formed with one or more slots extending from at least one edge thereof, said slots being of such width that when the insulated wire portion is inserted into the slot the metal edges and the slot sides penetrate the insulating material on the wire and make electrical contact with the wire.

3. An assembly as claimed in claim 2 wherein the metal contact elements are each provided with at least two slots.

4. An assembly as claimed in claim 3 wherein the said slots are disposed to extend from opposite edges of the element.

5. An assembly as claimed in any one of claims 2 to 4 inclusive wherein each contact element comprises a portion of metal sheet doubled to provide two substantially parallel portions with a portion connecting the parallel portions, slots being formed in the opposing free edges of the parallel portions.

6. An assembly as claimed in claim 1 wherein the transformer ring core is a toroidal ring core of ferrite material.

7. An assembly as claimed in claim 6 wherein the toroidal ring core with its secondary winding, the contact elements and the portions of wire adjacent thereto are encased in a synthetic plastics case, the case being provided with apertures coincident with the central opening of the toroidal ring core through which apertures a loop of insulated wire may be threaded to serve as a primary winding for the transformer.

8. An assembly as claimed in claim 7 wherein the apertures are formed so as to leave a portion of the inside circumferential surface of the ring core exposed.

9. An assembly as claimed in claim 1 wherein the case is constructed in two portions, one portion being a lower or base portion and the other an upper or lid portion, one portion of the case being adapted to accommodate the end portions of the electrical leading wires of the ignition element and the other portion being adapted to accommodate the transformer ring core, the secondary winding and the contact elements, the case portions being adapted to close together so as to bring each contact element into contact with an electrical leading wire and an end portion of the secondary winding.

10. An assembly as claimed in claim 9 wherein the case portions are formed with at least one projection and at least one corresponding recess whereby, on closing the case, the two case portions become firmly locked together.

11. An assembly as claimed in claim 9 wherein the case is made as a single injection moulding with the two parts being joined by a thin hinge portion.

* * * * *